United States Patent [19]

van der Lijn et al.

[11] Patent Number: 4,995,310

[45] Date of Patent: Feb. 26, 1991

[54] DISPOSABLE FILTER CARTRIDGE, WHETHER OR NOT COMBINED WITH A WATER RESERVOIR

[75] Inventors: Joost van der Lijn, Utrecht; Bernardus M. Van Thoor, Maarsenbroek, both of Netherlands

[73] Assignee: Douwe Egberts Koninklijke Tabaksfabriek-Koffiebranderijen-Theehandel N.V., Utrecht, Netherlands

[21] Appl. No.: 303,860

[22] Filed: May 5, 1989

Related U.S. Application Data

[63] Continuation of Ser. No. 928,969, Nov. 10, 1986, Pat. No. 4,860,645.

[30] Foreign Application Priority Data

Nov. 11, 1985 [NL] Netherlands ..... 8503092
Apr. 16, 1986 [NL] Netherlands ..... 8600958

[51] Int. Cl.[5] ..... A47J 31/06

[52] U.S. Cl. ..... 99/295; 99/304; 99/306; 210/282

[58] Field of Search ..... 99/295, 304, 306; 426/77, 84, 433; 210/482, 282

[56] References Cited

U.S. PATENT DOCUMENTS

| | | | |
|---|---|---|---|
| 1,396,685 | 11/1921 | Houck | 99/306 X |
| 2,899,310 | 8/1959 | Dale . | |
| 3,411,431 | 11/1968 | Moerlini et al. | 99/304 |
| 3,446,624 | 5/1969 | Luedtke | 99/295 X |
| 3,795,182 | 3/1974 | Van Damme | 99/306 |
| 3,985,069 | 10/1976 | Cavalluzzi . | |
| 4,158,329 | 6/1979 | McKnight | 99/295 |

FOREIGN PATENT DOCUMENTS

| | | | |
|---|---|---|---|
| 790706 | 10/1972 | Belgium . | |
| 0114717 | 8/1984 | European Pat. Off. . | |
| 1207866 | 12/1965 | Fed. Rep. of Germany . | |
| 1429932 | 3/1969 | Fed. Rep. of Germany | 210/482 |
| 1947146 | 12/1971 | Fed. Rep. of Germany . | |
| 3432339 | 3/1985 | Fed. Rep. of Germany . | |
| 8533170 | 3/1986 | Fed. Rep. of Germany . | |
| 2213757 | 8/1974 | France . | |
| 527592 | 10/1972 | Switzerland . | |
| 1064010 | 4/1967 | United Kingdom . | |

*Primary Examiner*—Paul T. Sewell
*Assistant Examiner*—M. D. Patterson
*Attorney, Agent, or Firm*—Scully, Scott, Murphy & Presser

[57] ABSTRACT

A disposable filter cartridge comprising a housing substantially including a bottom and an upright side wall, the underside or bottom having one or more holes, said filter cartridges being provided at its top and at least a part of its bottom with filter material or a filter film. At least the filter material for the top is connected to the side wall or a flange-shaped extension thereof by means of a sealed joint. The filter material destined for the underside or bottom of the housing is cup-shaped and is received in the housing of the filter cartridge so as to be immovable.

7 Claims, 4 Drawing Sheets

DISPOSABLE FILTER CARTRIDGE, WHETHER OR NOT COMBINED WITH A WATER RESERVOIR

CROSS-REFERENCE TO RELATED APPLICATIONS

This application is a continuation of U.S.S.N. No. 928,969, now U.S. Pat. No. 4,860,645.

BACKGROUND OF THE INVENTION

1. Field of the Invention

The present invention relates to a disposable filter cartridge comprising a housing, substantially including a bottom and an upright side wall, the underside or bottom having one or more holes, said filter cartridge being provided at its top and at least a part of its bottom with filter material or a filter film, with at least the filter material for the top being connected through a sealed joint to the side wall or a flange-shaped extension thereof, as disclosed in Applicant's Dutch application No. 83.00213 and in British patent No. 1,064,010 to M.I.K.O. and U.S. Pat. No. 3,823,656 to Germaine van der Veken.

These known cartridges serve for making one or more consumption units of coffee: the cartridges may naturally also be used for making other beverages.

In these known filter cartridges, the filter material at the bottom is sealed or thermo-stuck to the circumference of the hole or holes in the bottom.

Also known are disposable filter cartridges whose circumferential side walls of the filter cartridge have upper and lateral extensions respectively in order to form a complete disposable filter with water reservoir. In this case, reference can be made to Belgian patent No. 52.280 to M.I.K.O.

A drawback of these known constructions is that only a limited part of the bottom filter surface, viz. the part of the filter material within the seam, is effectively available for filtration, which results in a relatively low filtration speed and relatively long brewing times. This led to the use of disposable filter cartridges with a relatively large diameter and a thin coffee bed. This, in turn, however, gave a low extraction efficiency.

SUMMARY OF THE INVENTION

It is an object of the present invention to remove these drawbacks. To this effect, according to the present invention, a disposable filter cartridge of the above described type is characterized in that the filter material of the filter film adapted for covering the bottom of the housing is cup-shaped and is received in the housing of the filter cartridge so as to the immovable. As a consequence the total filter surface is available for filtration.

In a suitable embodiment, the height of the cup-shaped filter material is equal to the distance between the bottom of the housing of the disposable filter cartridge and the filter material or the filter film at the top of the cartridge, so that a good fixation of the cup-shaped filter material is ensured.

In a further elaboration of the present invention, when the filter material at the bottom is connected through a sealed joint to the side wall, or the bottom of the housing, the space formed outwardly of the bottom seam, between the bottom and the superjacent filter material, is in open communication with a hole in the bottom. For instance, the bottom seam may be discontinuous.

When the seam between the lower filter and the bottom is provided on a raised portion thereof (so that it is technically easy to seal the filter onto the bottom), the communication may be effected through one or more cut-outs in said raised portion. Another possibility is that one or more passages are provided under the filter material in the bottom or sidewall, outwardly of said raised portion of the bottom portion of the housing.

In another embodiment of the present invention, the object contemplated is achieved by imparting a cup-shaped design to the lower filter and by sealing the upper edge thereof, at the top of the filter cartridge, onto the side wall or an upper edge of the housing, i.e. above the level of the material to be extracted. In this construction a sealed joint at the bottom may be absent therefore, resulting a considerably larger filter surface area being available for percolation.

The present invention further relates to a disposable filter cartridge comprising a housing, substantially including a bottom and an upright side wall, the underside or bottom having one or more holes and the top and bottom of said filter cartridge being provided with filter material, said filter cartridge being characterized in that the circumferential side wall of the filter cartridge is extended upwardly and laterally in order to form a complete disposable filter with water reservoir.

BRIEF DESCRIPTION OF THE DRAWINGS

Some embodiments of the disposable filter cartridge according to the present invention will now be described, by way of example, with reference to the accompanying drawings, in which.

DETAILED DESCRIPTION OF THE PREFERRED EMBODIMENTS

Figure 1:
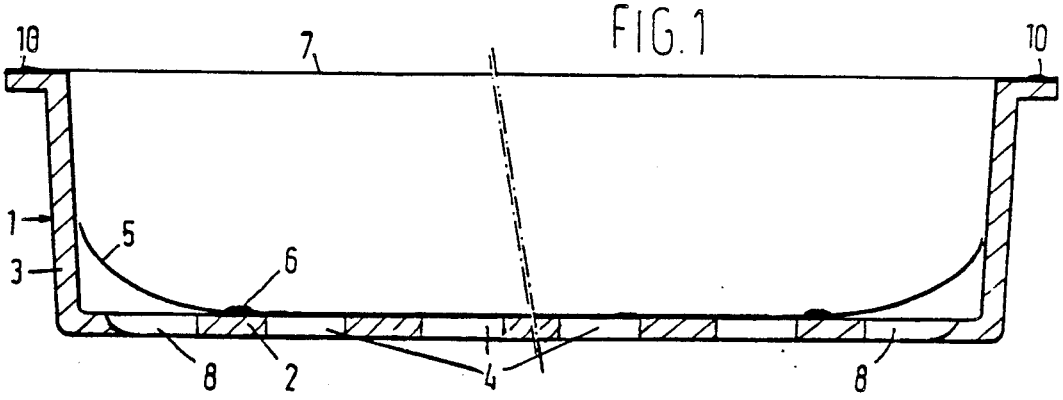
FIG. 1 is a cross section of a first embodiment of a disposable filter cartridge, according to the present invention
Figure 2:
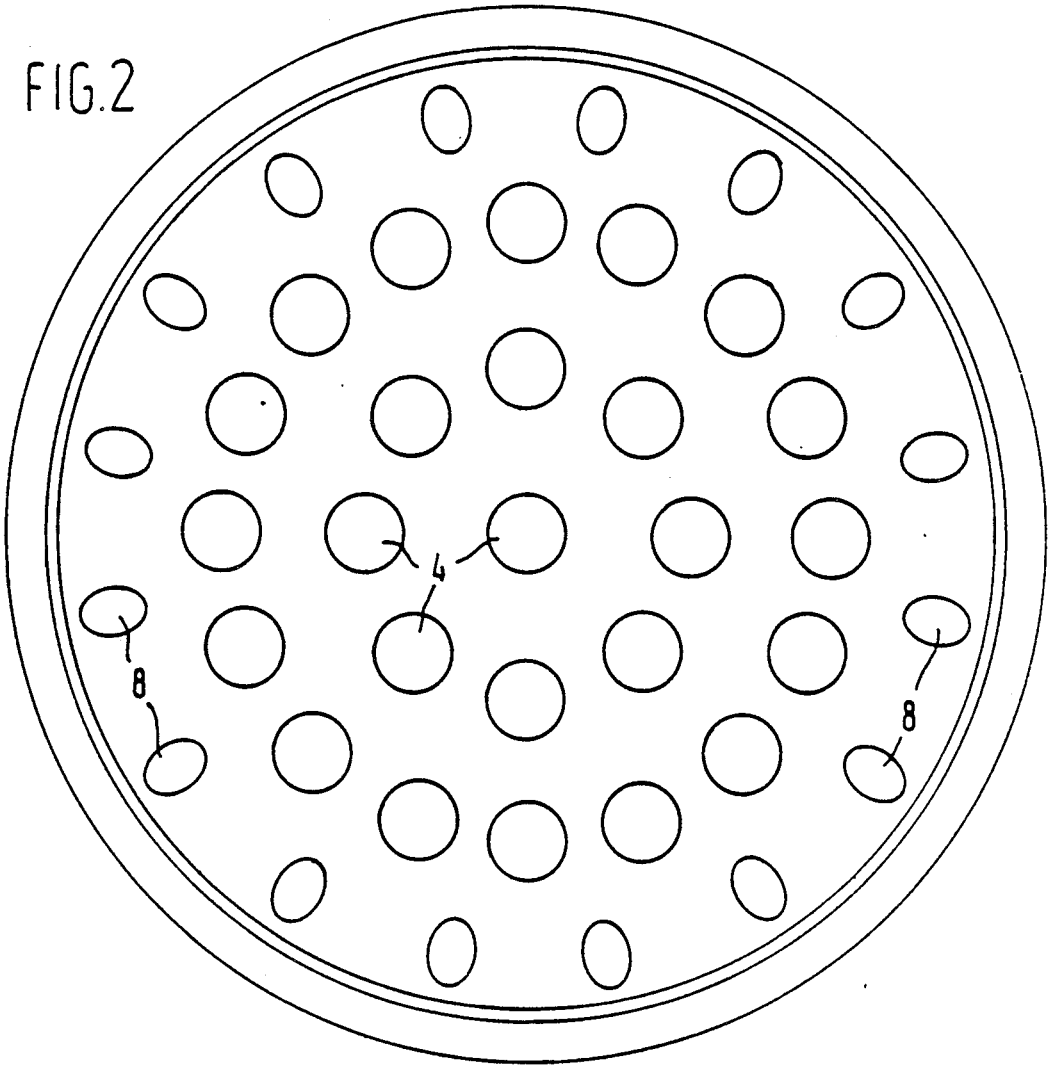
FIG. 2 is a bottom view of the disposable filter cartridge of FIG. 1

As shown in the drawings, a disposable filter cartridge comprises a housing generally indicated at 1, including a bottom 2 and an upright side wall 3. The bottom of each cartridge is provided with one or more holes 4. In the filter cartridge there is also disposed on the inside near the bottom a filter film or like filter material 5. Such a material is well known in the art and is also employed in disposable filters or disposable filter cartridges as described in the introduction to this specification. This filter film 5 is sealed onto the bottom at the location 6. Adjacent the top of the filter cartridge a similar film 7 is sealed by means of a seam 10. In order that filtrate formed outwardly of the seam 6 in the space between the bottom 2 and the superjacent filter film 5 may be discharged, various solutions are indicated in the drawings.

FIG. 1 shows cut-outs 8 in the bottom extending from said space up to the underside of the bottom.

Figure 3:
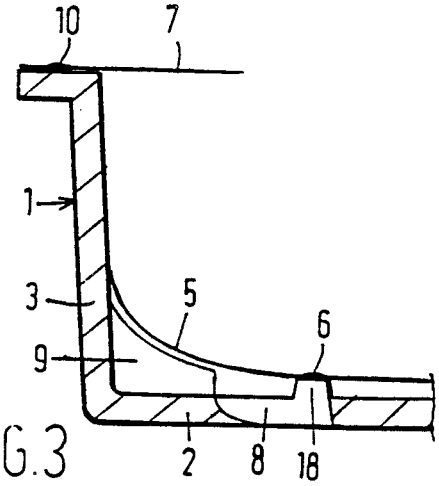
FIGS. 3-6 are part-cross-sectional views similar to FIG. 1 of alternative embodiments and FIG. 7 is a cross-sectional view similar to FIG. 1, but on a reduced scale, and showing a disposable filter cartridge having a water reservoir

The embodiment shown in FIG. 3 concerns a similar solution, except that the filter film 5 is sealed onto a raised edge 18 of the bottom and the cut-outs 8 extend also through the raised edge 18. Furthermore, in the embodiment shown in FIG. 3, the cartridge is provided at its bottom with a plurality of supporting partitions 9 for supporting the filter film 5.

Figure 4:
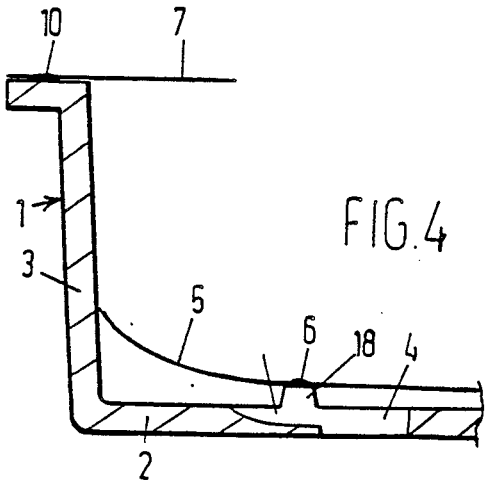

The embodiment shown in FIG. 4 differs from that shown in FIG. 3 to the extend that said partitions are omitted and the hole 8 is in direct communication only with one of the holes 4 in the bottom.

Figure 5:
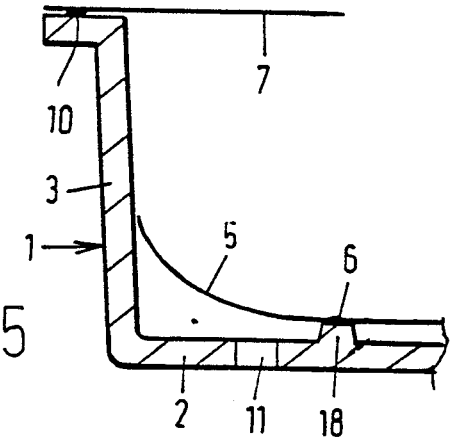

In the embodiment shown in FIG. 5 the space between bottom 2 and the superjacent filter film 5, outwardly of the seam 6, is in direct communication with the surroundings through holes 11.

Figure 6:
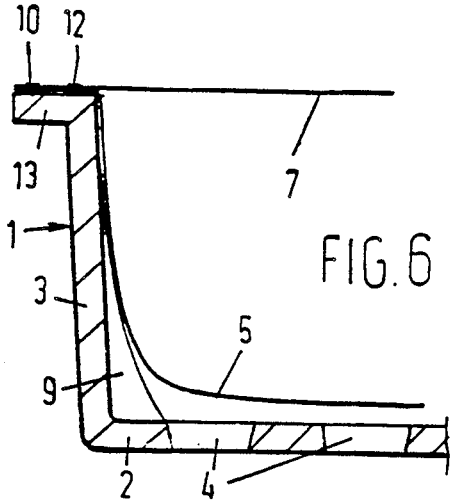

The above described embodiments all have a substantially equal filtering surface area. A substantial enlargement thereof is obtained in the embodiment shown in FIG. 6, wherein the bottom filter film 5 is cup-shaped and the outer circumferential edge thereof is sealed onto an upper circumferential edge 13 of the upright side wall or onto the top of the side wall at seam 12. Seam 10 of the upper filter film 7 is located outwardly thereof. In this manner, there is produced a disposable filter pattern having a very large filtering surface area, while this construction can be easily manufactured. In the embodiment shown, also supporting partitions are depicted.

Figure 7:
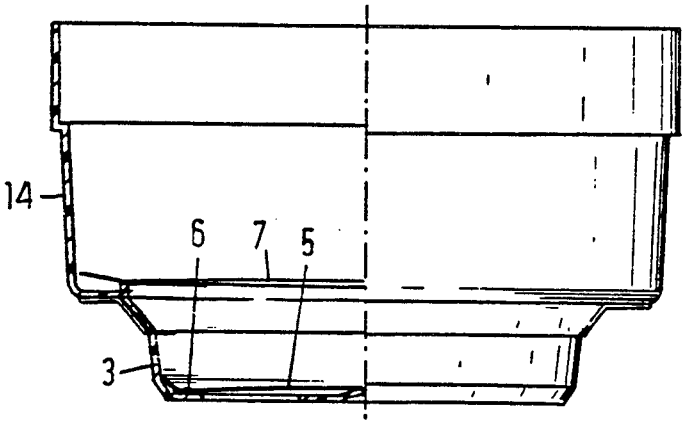

FIG. 7 shows a disposable filter cartridge whose upright side wall 3 is extended upwardly and laterally in order to form a complete disposable filter with water reservoir; the extension is generally indicated at 14.

The bottom of the disposable filter cartridge shown in FIG. 7 corresponds substantially to that of FIG. 1.

Figure 8:
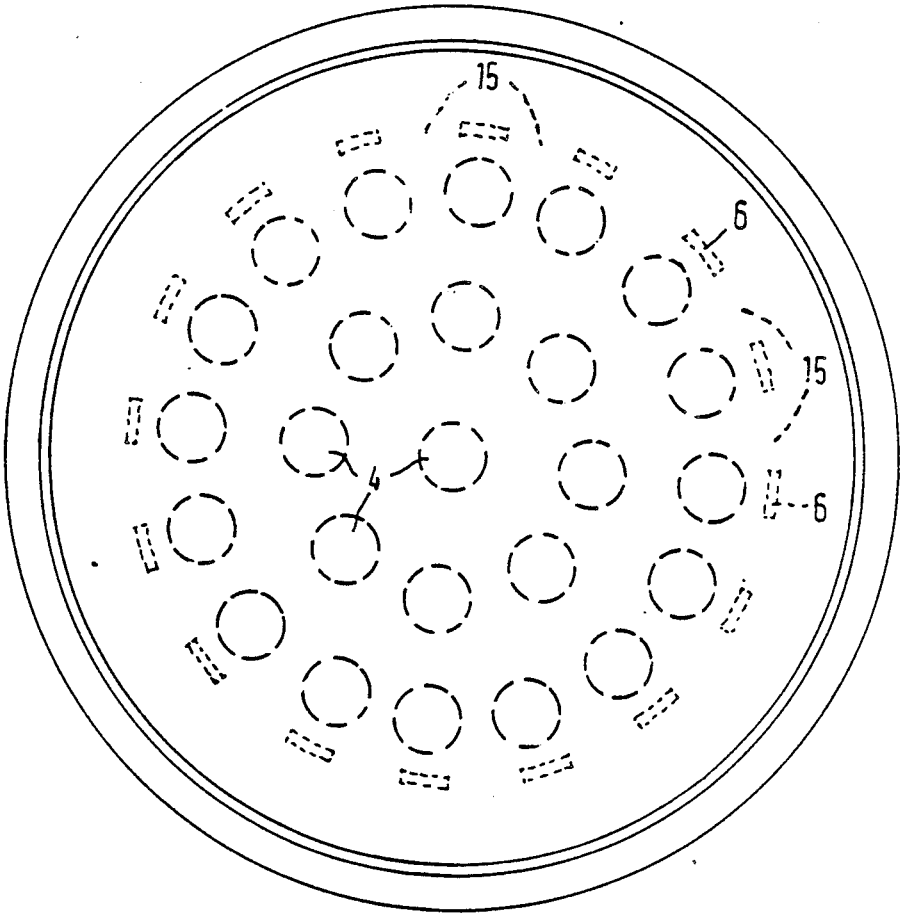
FIG. 8 is a top view of a further embodiment.

FIG. 8 shows an embodiment of a disposable filter cartridge similar to FIG. 1 but with the cut-outs 8 being omitted and instead thereof a discontinuous seam 6 in order to form a passage for the filtrate through discontinuities 15.

EXAMPLE

Cartridge with 6 g of coffee and 140 ml of poured water gives 120 ml of brew.

| | | |
|---|---|---|
| external cartridge diameter | 55 | 60 mm |
| hole diameter (mm) | 43 | 48 mm |
| traditional filter | | |
| according to Dutch application 8300213 | | |
| percolation time (min.) | 3.5 | 2.3 |
| extraction efficiency (%) | 28.3 | 26.6 |
| filter according to this invention (FIG. 4) | | |
| percolation time (min.) | 2.3 | |
| extraction efficiency (%) | 27.7 | |

Figure 9:
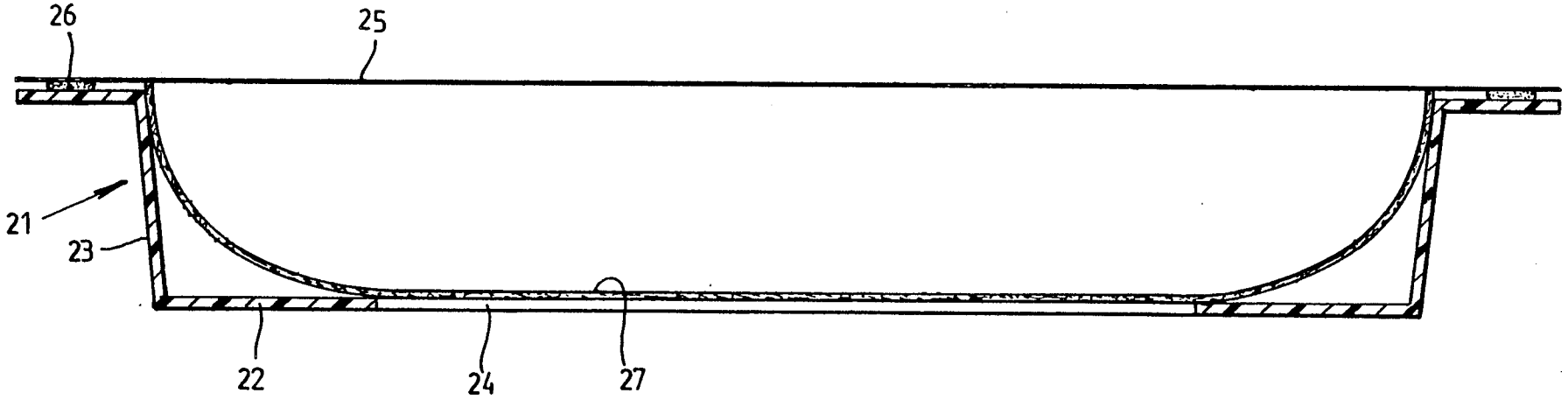
FIG. 9 shows yet another embodiment of the disposable filter cartridge according to the present invention.

This disposable filter cartridge shown in FIG. 9 has a housing generally indicated at 21 and consisting of a bottom 22 and an upright side wall 23. The bottom of each cartridge has one or more holes 24.

Near the top of the filter cartridge there is provided a filter film or like filter material 25. Such a material is well known in the art and is also employed in the disposable filters or disposable filter cartridges described in the introduction to this specification. The filter film is sealed onto the housing adjacent an upper circumferential edge of the housing by means of a seam 26.

For closing the bottom of the housing, a cup-shaped filter film 27 is placed in the bottom portion, which film, in the embodiment shown, has a height equal to the distance between the upper filter film 25 and the bottom 24 of the housing, with the result that the cup-shaped filter film 27, in mounted condition, cannot slide, in other words, the material to be filtered contained therein continues to be contained therein also during transport of the cartridge.

If desired, the filter film 27 destined for the bottom may be sealed adjacent its upper circumferential edge locally onto the upright side wall of the housing. This ensures that even when the filter film and the contents of the filter cartridge become wet the filter film 27 will not be shifted.

What we claim:

1. A disposable filter cartridge comprising a housing including a bottom and an upright side wall, the bottom having at least one hole formed therein, said filter cartridge being provided at its top and bottom with filter material, the bottom filter material being cup-shaped and connected to the housing by a sealed joint, a space being formed outwardly of the sealed joint between the housing and the cup-shaped bottom filter material, said space being in open communication with said at least one hole in the bottom.

2. A disposable filter cartridge according to claim 1, wherein said cup-shaped bottom filter material extends to a height about the edge thereof which is equal to the distance between said housing bottom and the top filter material.

3. A disposable filter cartridge according to claim 1 wherein the bottom seam is discontinuous.

4. A disposable filter cartridge according to claim 1, wherein the sealed joint between the housing bottom and the bottom filter material is formed on a raised surface portion of the housing bottom, and at least one cut-out extends through said raised surface portion.

5. A disposable filter cartridge according to claim 1, wherein the sealed joint between the housing bottom and the bottom filter material is formed on a raised surface portion of the housing bottom, and holes are formed in said housing bottom radially outwardly of said raised surface portion communicating with said space underneath the bottom filter material.

6. A disposable filter cartridge according to claim 2, wherein the bottom filter material has an outer circumferential edge thereof sealed onto a top circumferential edge of the upright side wall.

7. A disposable filter cartridge according to claim 1, wherein the side wall of the filter cartridge extends upwardly and laterally outwardly to form a complete disposable filter structure with a water reservoir.

* * * * *